US008757532B2

(12) United States Patent
Votel et al.

(10) Patent No.: US 8,757,532 B2
(45) Date of Patent: Jun. 24, 2014

(54) RETRACTABLE LANYARD

(75) Inventors: Thomas Votel, Sunfish Lake, MN (US); Justin Kostner, Minneapolis, MN (US); Jeffrey A. Popowski, Roseville, MN (US)

(73) Assignee: Tenacious Holdings, Inc., St. Paul, MN (US)

( * ) Notice: Subject to any disclaimer, the term of this patent is extended or adjusted under 35 U.S.C. 154(b) by 240 days.

(21) Appl. No.: 13/326,576

(22) Filed: Dec. 15, 2011

(65) Prior Publication Data

US 2012/0153064 A1 Jun. 21, 2012

Related U.S. Application Data

(60) Provisional application No. 61/424,338, filed on Dec. 17, 2010.

(51) Int. Cl.
*B65H 75/48* (2006.01)

(52) U.S. Cl.
USPC ..... 242/378; 242/378.1; 242/378.2; 242/378.3

(58) Field of Classification Search
CPC .. B65H 75/362; B65H 75/406; B65H 75/486; B65H 75/4402; B65H 75/4434
USPC ..... 242/378, 378.1–378.3, 379, 601
See application file for complete search history.

(56) References Cited

U.S. PATENT DOCUMENTS 529,402 A 11/1894 McDougall
721,460 A 2/1902 McDougall
1,120,341 A 12/1914 Smith
1,232,299 A 7/1917 Hance
1,374,459 A 4/1921 Lichty
1,465,281 A 8/1923 Morrison
1,567,783 A 12/1925 Best
1,826,465 A 10/1931 Gilman
2,087,176 A 7/1937 Webb
2,311,823 A 2/1943 Gaskill
2,429,675 A * 10/1947 Eypper ..... 242/388.1
2,435,081 A 1/1948 Howard
2,525,890 A 10/1950 Gage
2,706,967 A 4/1955 Iannetti
2,713,327 A 7/1955 West
2,732,148 A 1/1956 Lummis
2,987,043 A 6/1961 Spindler
3,054,573 A 9/1962 Spencer
3,062,478 A 11/1962 Adachi et al.
3,100,608 A 8/1963 Goldfarb
3,233,591 A 2/1966 Rogers et al.
3,547,371 A 12/1970 Gruseck
3,672,597 A 6/1972 Williamson
3,693,596 A 9/1972 Croce et al.
3,968,670 A 7/1976 Quenot (Continued)

*Primary Examiner* — Sang Kim

(57) ABSTRACT

The present disclosure is directed to a novel heavy duty, weather and shock resistant retractable lanyard. In one aspect of the disclosure, the retractable lanyard comprises dual independently retractable lanyard cords that share a common axis. In another aspect of the disclosure, the retractable lanyard employs a multi-piece reader arm pivotally connected to a reader arm bracket to assist the lanyard in operating under heavier loads. In another aspect of the disclosure, the lanyard may employ deeper tracks on the spool's track system to allow the reader arm to stay in contact with the tracks when the lanyard cord is under heavier loads. In another aspect of the disclosure, the lanyard comprises a robust power spring that allows it to retract under heavier loads.

13 Claims, 15 Drawing Sheets

(56) References Cited

U.S. PATENT DOCUMENTS

| | | | | |
|---|---|---|---|---|
| 4,146,191 | A | 3/1979 | Cavanaugh | |
| 4,269,150 | A | 5/1981 | McCarthy | |
| 4,286,387 | A | 9/1981 | Di Diego | |
| 4,501,230 | A | 2/1985 | Talo | |
| 4,580,347 | A | 4/1986 | McKnight | |
| 4,620,506 | A | 11/1986 | Stubbs | |
| 4,662,078 | A | 5/1987 | Gammon et al. | |
| 4,800,843 | A | 1/1989 | Wendling | |
| 5,022,351 | A | 6/1991 | Daniels | |
| 5,031,577 | A | 7/1991 | Flugger | |
| 5,044,323 | A | 9/1991 | Papak | |
| 5,079,851 | A | 1/1992 | Sill | |
| 5,230,117 | A | 7/1993 | Johnson et al. | |
| 5,353,747 | A | 10/1994 | Fain | |
| 5,358,158 | A | 10/1994 | Darr | |
| 5,363,680 | A | 11/1994 | Wu | |
| 5,377,626 | A | 1/1995 | Kilsby et al. | |
| 5,462,019 | A | 10/1995 | Hong-Rong et al. | |
| 5,490,805 | A | 2/1996 | Bredesen | |
| 5,553,810 | A * | 9/1996 | Bobeczko | 242/601 |
| 5,674,437 | A | 10/1997 | Geisel | |
| 5,732,662 | A | 3/1998 | Jacobsen | |
| 5,740,764 | A | 4/1998 | Jacobsen | |
| 5,833,165 | A | 11/1998 | Paugh | |
| 5,864,925 | A | 2/1999 | McGee | |
| 5,887,550 | A | 3/1999 | Levine et al. | |
| 5,938,137 | A | 8/1999 | Poulson | |
| 5,954,288 | A | 9/1999 | Shih | |
| 5,957,092 | A | 9/1999 | Colsch | |
| 5,983,836 | A | 11/1999 | Chavez | |
| 6,056,450 | A | 5/2000 | Walling | |
| 6,073,875 | A | 6/2000 | Paugh | |
| 6,082,656 | A | 7/2000 | Thornton | |
| 6,112,357 | A | 9/2000 | Halloran | |
| 6,148,773 | A | 11/2000 | Bogdahn | |
| 6,192,835 | B1 | 2/2001 | Calhoun et al. | |
| 6,213,421 | B1 | 4/2001 | Franklin | |
| 6,243,921 | B1 | 6/2001 | Chang | |
| 6,290,158 | B1 | 9/2001 | Huang | |
| 6,314,916 | B1 | 11/2001 | Watson, Sr. | |
| 6,364,237 | B1 | 4/2002 | Kagel | |
| 6,371,056 | B1 | 4/2002 | Phillips | |
| 6,401,656 | B1 | 6/2002 | Adkisson | |
| 6,405,683 | B1 | 6/2002 | Walter et al. | |
| 6,419,175 | B1 | 7/2002 | Rankin, VI | |
| 6,487,756 | B1 | 12/2002 | Vidal, Jr. | |
| 6,502,727 | B1 | 1/2003 | Decoteau | |
| 6,523,500 | B1 | 2/2003 | Zenteno | |
| 6,526,918 | B1 | 3/2003 | Arnold | |
| 6,578,683 | B1 | 6/2003 | Burke et al. | |
| 6,584,724 | B1 | 7/2003 | Le Blanc | |
| 6,612,263 | B2 | 9/2003 | Scheid et al. | |
| 6,619,313 | B2 | 9/2003 | Boughton et al. | |
| 6,731,956 | B2 | 5/2004 | Hanna et al. | |
| 6,935,277 | B2 | 8/2005 | Vaccari | |
| 6,966,519 | B2 | 11/2005 | Salentine et al. | |
| 7,007,882 | B2 | 3/2006 | Raia et al. | |
| 7,040,257 | B2 | 5/2006 | Waxman et al. | |
| 7,354,304 | B2 | 4/2008 | Livingston | |
| 7,364,109 | B2 * | 4/2008 | Kuo | 242/373 |
| 7,380,357 | B2 | 6/2008 | Jones et al. | |
| 7,384,013 | B2 * | 6/2008 | Yen | 242/378 |
| 7,607,603 | B1 * | 10/2009 | Chang | 242/378.1 |
| 7,762,215 | B2 | 7/2010 | Horton | |
| 8,136,751 | B2 * | 3/2012 | Chen | 242/378.1 |

* cited by examiner

RETRACTABLE LANYARD

CLAIM OF BENEFIT TO PRIOR APPLICATIONS

This application claims the benefit of U.S. Provisional Application No. 61/424,338 filed Dec. 17, 2010; and such application is hereby fully incorporated by reference herein.

FIELD

The present invention relates generally to retractable lanyards. More particularly, the present invention relates to an improved retractable lanyard, configured to attach to a person or object, that is durable, shock resistance, weather resistant and has a strong recoil force to support heavier objects. The present invention also relates to a retractable lanyard with more than one retractable line.

BACKGROUND

The basic retractable lanyard is known in the art. The McDougall patents, U.S. Pat. No. 529,402 and U.S. Pat. No. 721,460 are representative. The McDougall patents disclose a short retractable tether cord used for tethering light objects to ones person, such as eye glasses. The Smith patent, U.S. Pat. No. 1,120,341 is another example of an early retractable lanyard.

The basic retractable lanyard is not designed for substantial and continuous outdoor use or use under demanding conditions such as those found on construction sites. The basic retractable lanyard design is not weather or shock resistant. The basic retractable lanyard is also not designed to accommodate single or multiple heavier objects, such as hand tools, on one or more retractable tether cords incorporated into a common retractable lanyard housing.

For at least these above-described reasons, there is a need for an improved retractable lanyard.

SUMMARY

The present disclosure is directed to a durable, shock and weather resistance retractable lanyard. In one aspect of the disclosure, the retractable lanyard comprises an environmentally sealed spring and locking mechanism compartment. In another aspect of the disclosure, a single retractable lanyard housing allows for more than one retractable lanyard cord, each lanyard cord capable of operating independently of the other. In another aspect of the disclosure, the retractable lanyard housing is comprised in part of a compliant, shock absorbing, material. In yet another aspect of the disclosure, the retractable lanyard system operates with an automatic lock and release mechanism for one handed operation. In another aspect of the disclosure, the lanyard system contains a heavy-duty, multi-piece reader arm and reader arm bracket combined with a robust recoil and locking mechanism to allow the lanyard cord to operate and retract even under relatively heavy loads. In yet a further aspect of the disclosure, the retractable lanyard system contains an attachment member to allow attachment of the lanyard system to a person or object. The attachment member may also pivot and may have a breakaway safety feature.

The above summary is not intended to limit the scope of the invention, or describe each embodiment, implementation, feature or advantage of the invention. It is understood that the features mentioned hereinbefore and those to be commented on hereinafter may be used not only in the specified combinations, but also in other combinations or in isolation, without departing from the scope of the present invention.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention.

Figure 1:
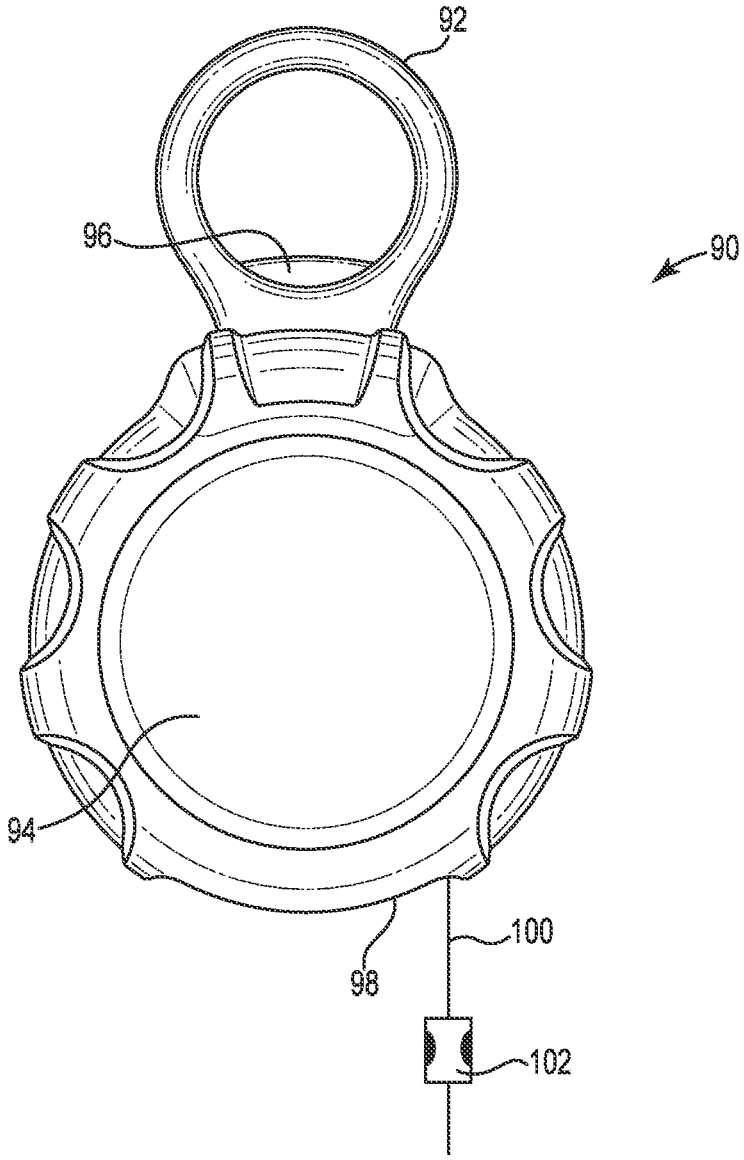
FIG. 1 is a front elevation view of a single cord embodiment of the present invention.
Figure 2:
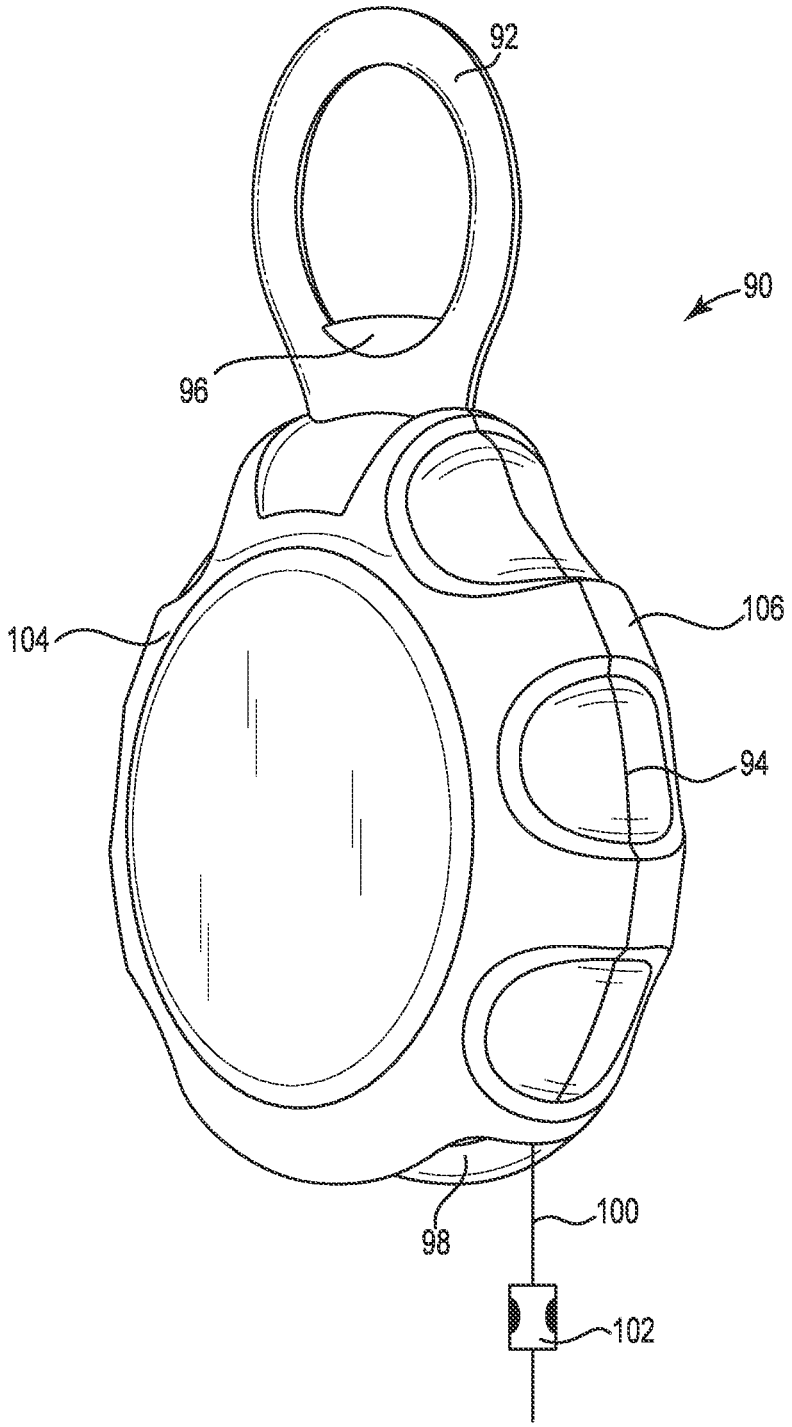
FIG. 2 is a perspective view of FIG. 1.
Figure 3:
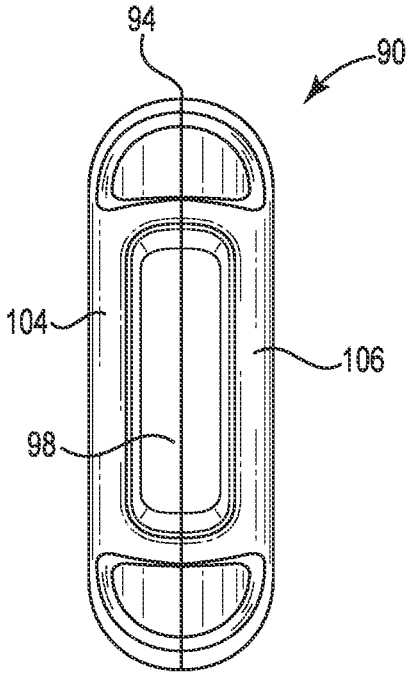
FIG. 3 is a bottom elevation view of FIG. 1.
Figure 4:
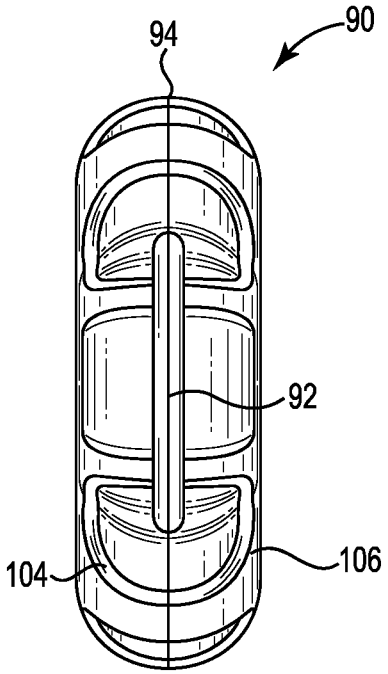
FIG. 4 is a plan view of FIG. 1.
Figure 5:
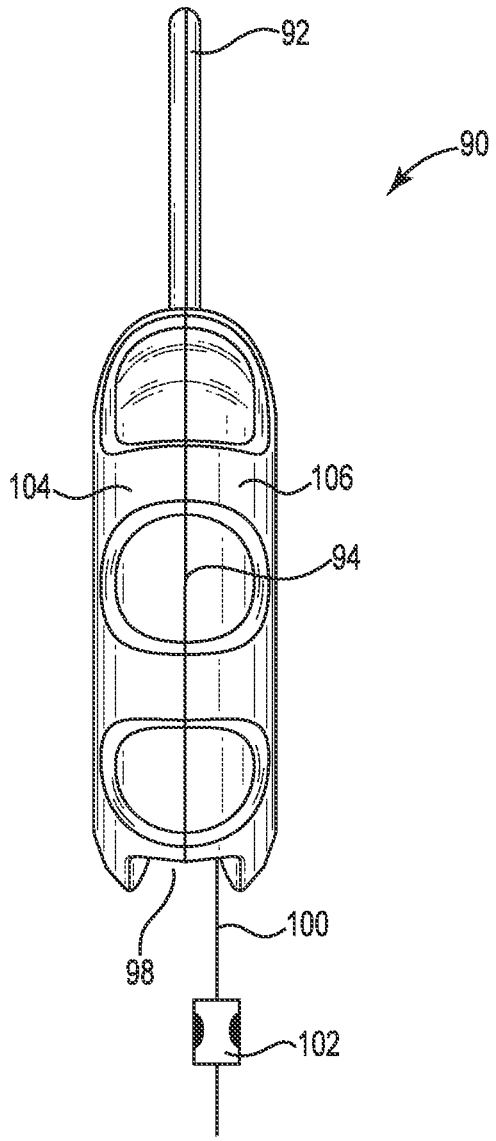
FIG. 5 is a side elevation view of FIG. 1.

FIG. 1 depicts a single spool embodiment of the retractable lanyard invention 90. Attachment member 92 is preferably circular in shape, which is useful to attach to a person by way of a hook or carabineer, and similarly useful in attaching to an object by similar means. Attachment member 92 can be fixably attached to lanyard housing 94, or releasably coupled to the lanyard housing 94, to detach at a pre-determined stress threshold, for safety considerations. For example, shear bolts may be used to secure attachment member 92 within housing 94 that allows the attachment member to detach from the housing when forces on the attachment member exceed 20 lbs. Attachment member 92 can also be pivotably coupled to lanyard housing 94 to allow more freedom of movement when the retractable lanyard is in use. Ledge 96 may also be incorporated into attachment member 92 to serve a bottle opening function. Other shapes of attachment member 92 may also be used. Opening 98 in housing 94 allows for the ingress and egress of lanyard cord 100. Lanyard clip 102 is integrated into lanyard cord 100 to allow for the attachment of objects to lanyard cord 100 of the subject invention.

FIGS. 2-6 depict various views of retractable lanyard 90.

Front case 104 and rear case 106 form housing 94. Attachment member 92 is preferably secured between front case 104 and rear case 106. One embodiment of the retractable lanyard includes substantial compliant shock absorbing elastomer materials such as rubbers, neoprene, silicones or other synthetic viscoelastic urethane polymers, in the construction of portions of housing 94. Weather resistance may be provided by the use of O-ring 101 in conjunction with the use of weather resistance material in the construction of the housings. O-ring 101 is preferably incorporated into rear case 106, and may also be similarly incorporated into front case 104, to assist in sealing the internal components of the invention from the environment. In another embodiment multiple sets of O-rings may be used.

In yet another embodiment the front and rear cases may also be formed to mate in a manner to form a weather resistant seal without the use of O-rings. Attachment member 92 may be secured between front case 104 and rear case 106. Apertures 120 and 122 in attachment member 92 may be used to house shear bolts as a safety consideration.

The internal components of lanyard 90 are generally comprised of power spring 108, spool 114 comprising a recessed side 116 and a track side (not visible) a perimeter portion 118, reader arm bracket 124 and reader arm 126. Lanyard cord 100 is spooled around perimeter portion 118 of spool 114. Spool 114 is configured to contain between 35 to 45 inches of lanyard cord 100. The lanyard cord 100 is preferably made of a synthetic fiber such as Kevlar.

Reader arm 126 is a substantially rigid element pivotally connected to reader arm bracket 124. Reader arm bracket 124 is preferably fixably connected to rear case 106. Reader arm bracket 124 provides additional support to reader arm 126 to assist in maintaining the reader arm's engagement within the tract side of spool 114, even while lanyard cord 100 is under heavy load.

Spool 114 is rotatably mounted within housing 94 and between front case 104 and rear case 106 through spool axis 140. Power spring 108 provides recoiling force and control for lanyard cord 100. Recess 116 of spool 114 is configured to accept power spring 108. The inner end 110 of power spring 108 may be fixably attached to the inside of front case 104. The outer end 112 of power spring 108 may be fixably attached to spool 114 within recess 116. The relative rotation of spool 114 with respect to front case cover 104, stores energy in power spring 108 to provide the force necessary to operate the invention. Power spring 108 is preferably between 0.2 and 0.3 inches thick and has a radius between 0.65 and 0.75 inches. In one embodiment the recoiling force is sufficient to control and retract the lanyard cord when attached objects that weigh up to two pounds.

Figure 7:
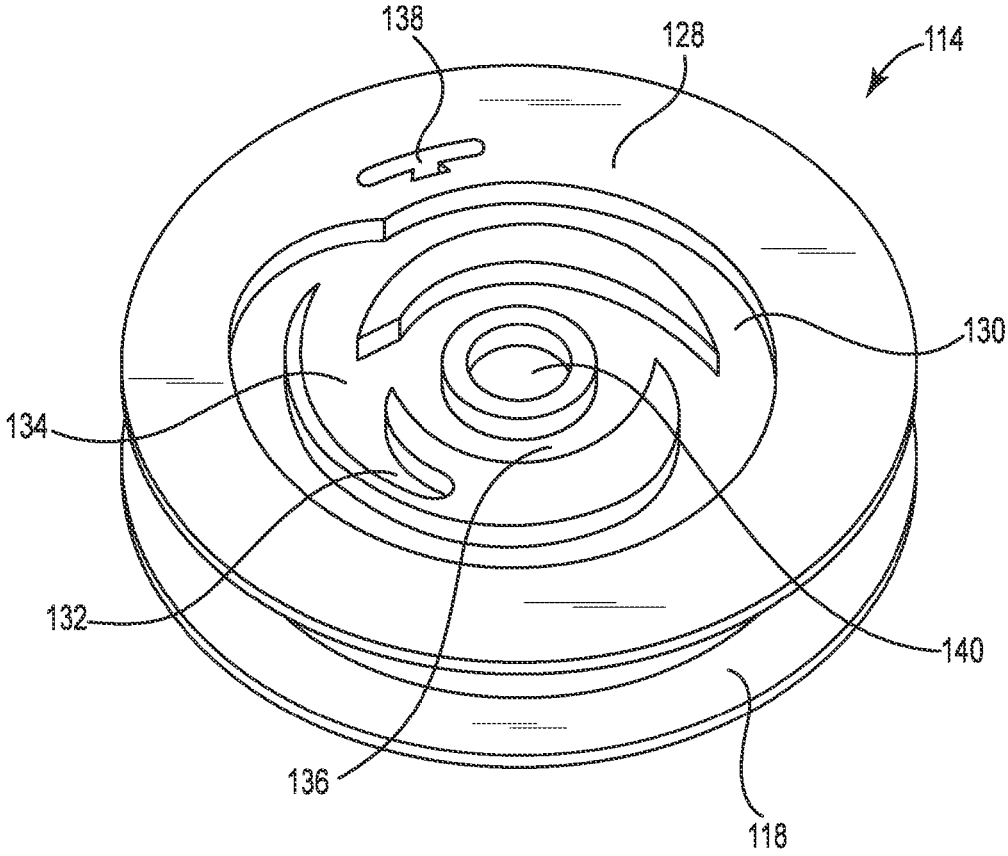
FIG. 7 is a perspective view of spool 114 from FIG. 6.
Figure 8:
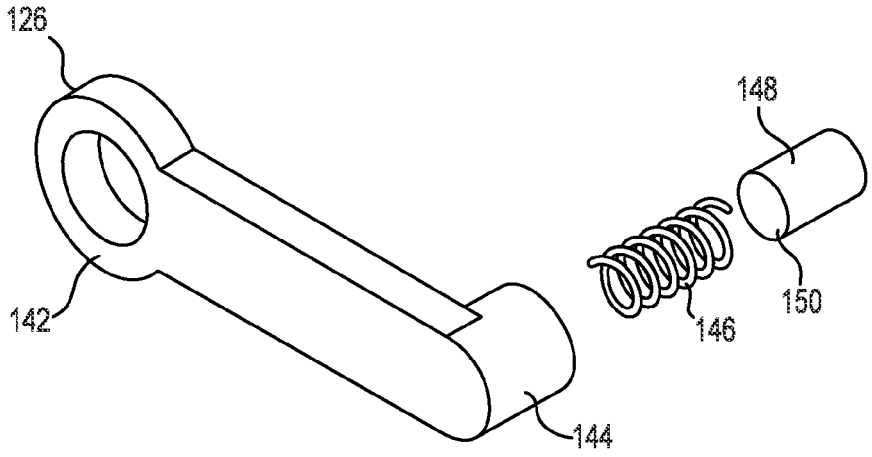
FIG. 8 is a perspective view of reader arm 126 from FIG. 6.

FIGS. 7 and 8 depict spool 114 and reader arm 126 respectively. Spool 114 comprises recessed area 116 on a first side (not shown), and track area 128 on a second side. Track area 128 contains a system of tracks in which reader arm 126 rides during the operation of the invention. Slot 138 provides an area on the perimeter to attached the lanyard cord to spool 114. The lanyard cord may alternately be attached on perimeter 118 of spool 114.

In a preferred embodiment, reader arm 126 comprises reader arm end 142, reader head 144, reader head spring 146 and reader head sleeve 148. Reader arm end 142 is pivotably attached to reader arm bracket 124. Reader head sleeve 148 is preferably a cylinder open at end 150 and sized to accept reader head spring 146. Reader head spring 146 engages reader head 144 while reader head sleeve 148 rides over reader head 144. Reader head sleeve 148 may optionally fit within reader head 144. Reader head spring 146 forces reader head sleeve 148 away from reader head 144, which forcibly engages reader head sleeve 148 with track areas 128 of spool 114, even when lanyard cord 100 is under a substantial load.

As an example of operation of the invention, when lanyard cord 100 is paid out from a fully recoiled position, spool 114 rotates in a counterclockwise direction and reader head sleeve 148 of reader arm 126 will move clockwise in outer most track 130 of tracks 128. When lanyard cord 100 is then released, the energy stored in power spring 108 will turn spool 114 in a clockwise direction and reader head sleeve 148 of reader arm 126 will move in a counterclockwise direction. Reader head sleeve 148 of reader arm 126 will then be diverted into dead-end track 132 and the recoiling of lanyard cord 100 will be halted. To retract the lanyard cord from a halted paid-out position, lanyard cord 100 is pulled out slightly and reader head sleeve 148 of reader arm 126 enters gap 134 in tracks 128 and is thereby diverted into inner track 136. Releasing lanyard cord 100 from this position will divert reader head sleeve 148 of reader arm 126 back into track 130 and lanyard cord 100 will then be free to fully retract under the stored force in power spring 108. This allows for improved and useful one-handed operation of the invention.

Preferably reader head sleeve 148 protrudes into tracks 128 of spool 114 by at least between 0.115 and 0.14 of an inch, to prevent reader head sleeve 148 from disengaging from tracks 128 while lanyard cord 100 is under heavy load. Tracks 128 are of sufficient width to allow reader head sleeve 148 to rotate while engaging tracks 128 of spool 114, to reduce wear on reader arm 126 and reader head sleeve 148 during operation.

Figure 9:
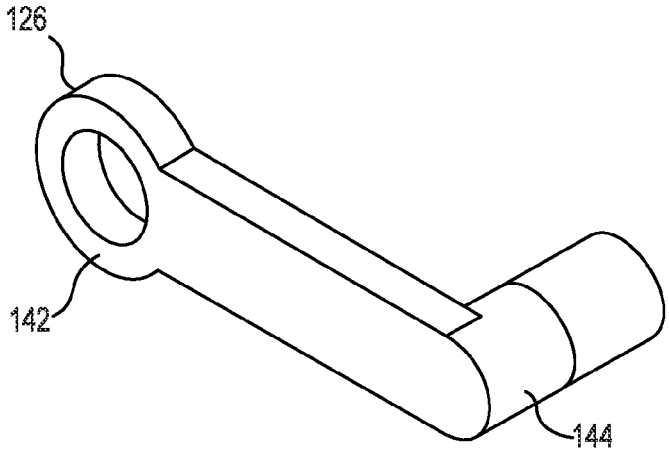
FIG. 9 is a perspective view of an alternate embodiment reader arm 152.

FIG. 9 depicts an alternate embodiment reader arm 152 wherein reader arm end 154 comprises an extended one piece unit that does not contain the sleeve 148 and spring 146 of FIG. 8. The invention operates as described above with reader head 154 riding in tracks 128 in place of reader head sleeve 148.

Figure 10:
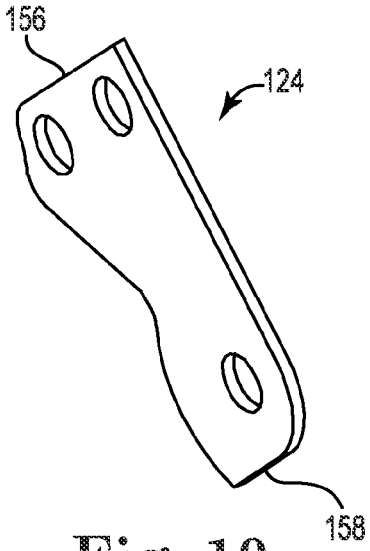
FIG. 10 is a front elevation view of reader arm bracket 124 of from FIG. 6.

FIG. 10 depicts a preferred embodiment of reader arm bracket 124. Reader arm bracket 124 comprising fixed end 156 that is fixably attached to housing 94, and pivot end 158 that pivotably accepts reader arm end 142.

Figure 11:
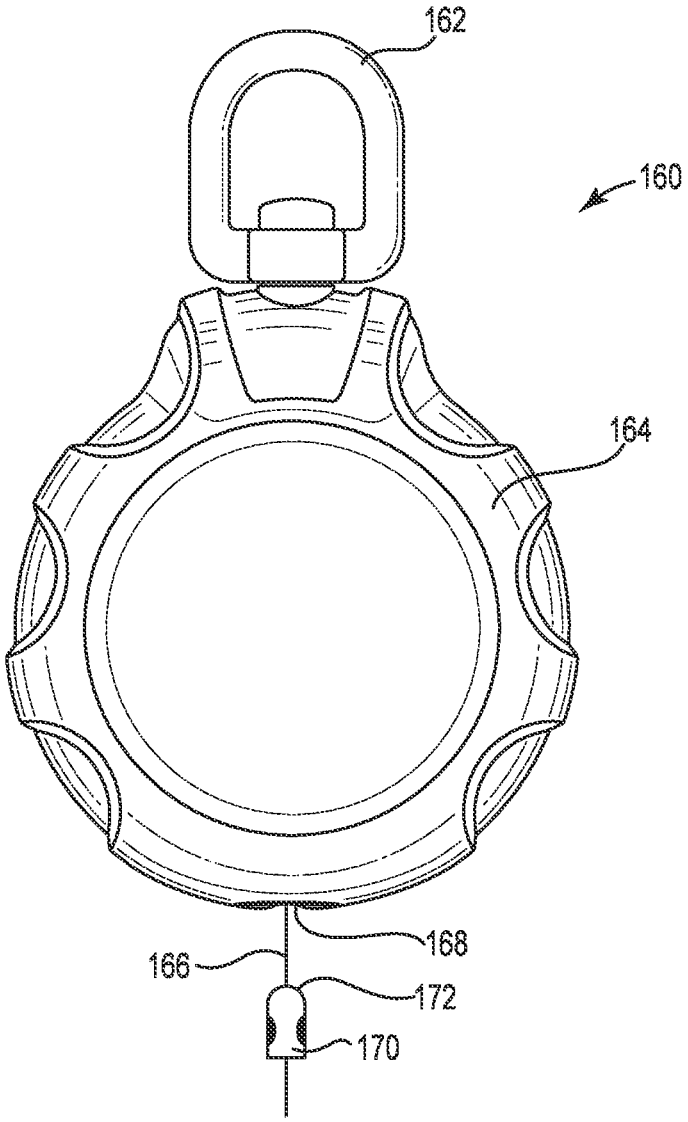
FIG. 11 is a front elevation view of alternate embodiment single cord retractable lanyard invention 160.

FIG. 11 depicts an alternate embodiment 160 of the invention. Retractable lanyard 160 includes attachment member 162 that is pivotably attached to housing 164. Lanyard cord opening 168 allows for the ingress and egress of lanyard cord 166. Cord clip 170 has a rounded portion 172 that is configured to mate with lanyard cord opening 168 to provide additional protection to the internal components of retractable lanyard 160 from the environment, when lanyard cord is fully retracted.

Figure 12:
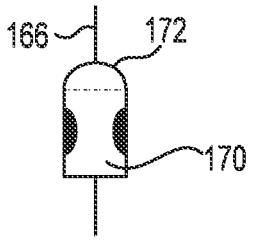
FIG. 12 is detailed elevation view of lanyard clip 170 from FIG. 11.

FIG. 12 depicts a more detailed view of cord attachment clip 170.

Figure 13:
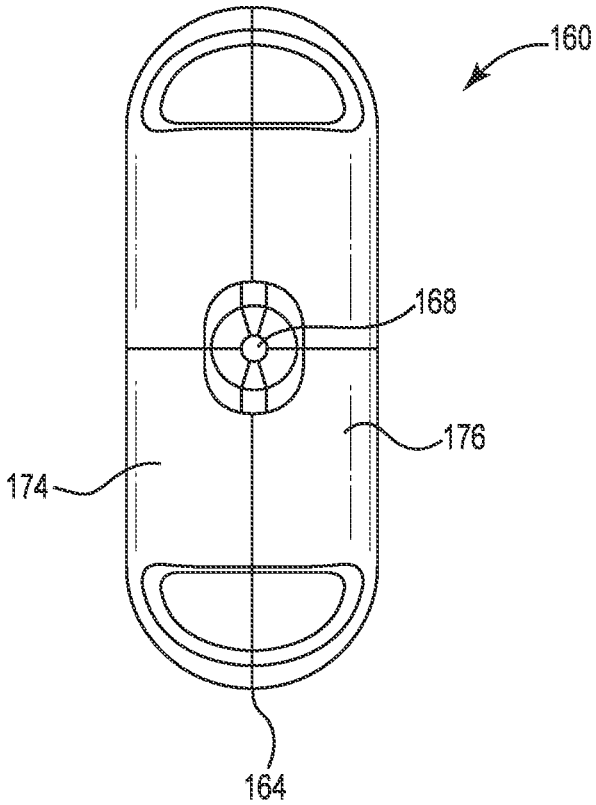
FIG. 13 is a bottom elevation view of FIG. 11.

FIG. 13 depicts a bottom view of retractable lanyard 160. Housing 164 is comprised of front case 174 and rear case 176.

Figure 14:
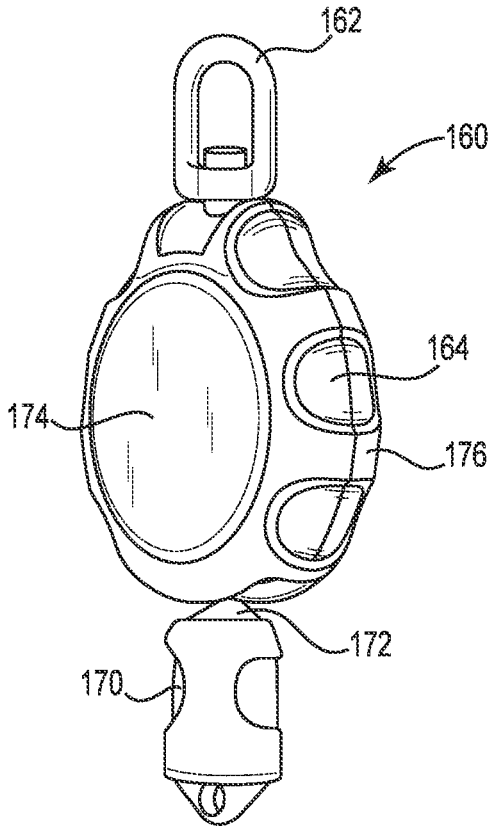
FIG. 14 is a perspective view of FIG. 11.

FIG. 14 depicts lanyard 160 with clip 170 retracted.

Figure 15:
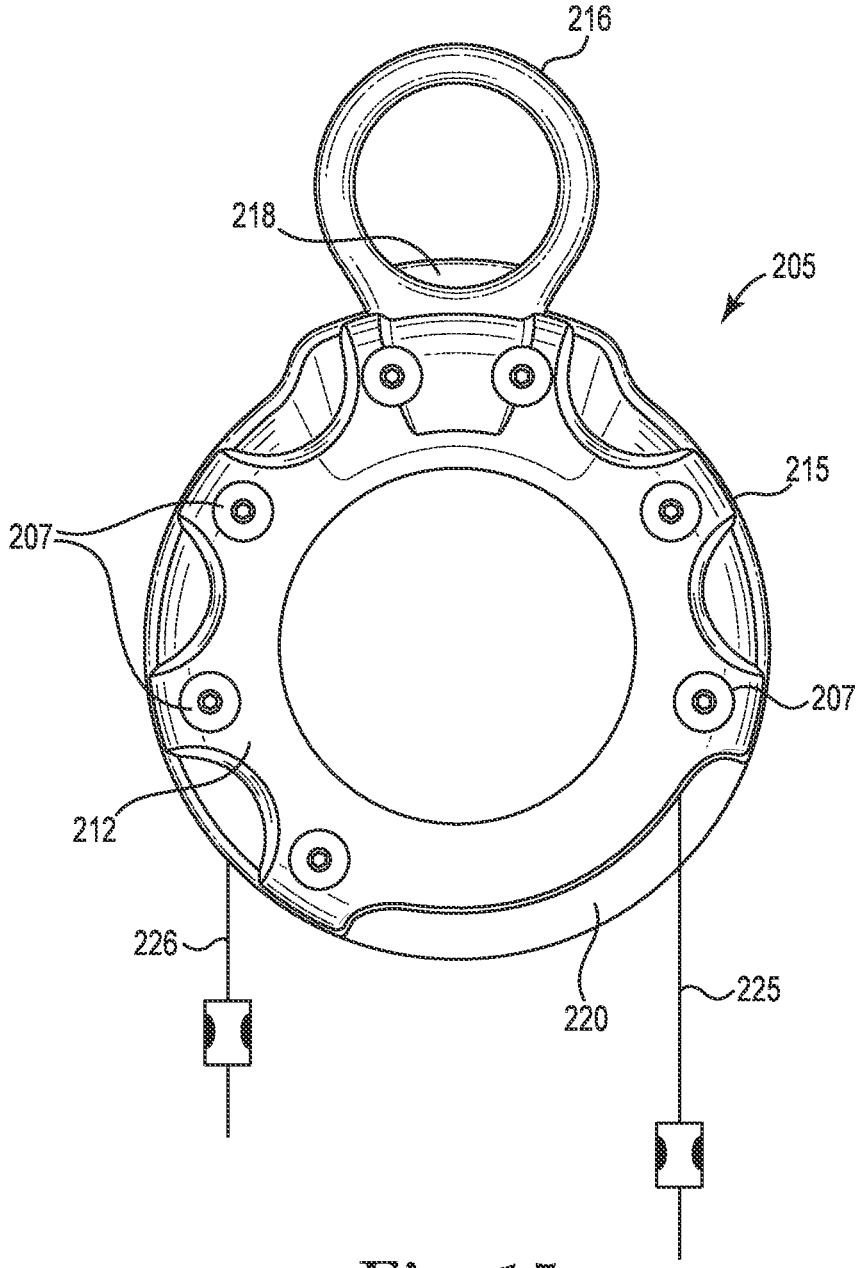
FIG. 15 is a front elevation view of a dual cord retractable lanyard embodiment of the invention.

FIG. 15 depicts a tandem spool embodiment 205 of the retractable lanyard invention. Tandem retractable lanyard housing 215 comprises front case 212 and rear case 214 (not shown). Attachment screws 207 may be used to hold housing 215 securely. Attachment member 216 maybe secured between front case 212 and rear case 214 or otherwise attached to housing 215. Ledge 218 provides for an optional bottle opener function. As with the single cord embodiments, attachment member 216 may be fixably attached to lanyard housing 215, or releasably coupled to the lanyard housing 215, to detach at a pre-determined stress threshold, for safety considerations. Attachment member 216 may also be pivotably coupled to lanyard housing 215 to allow more freedom of movement when the retractable lanyard is in use. Front lanyard cord opening 220 provides ingress and egress for front lanyard cord 225. Second lanyard cord 226 extends from rear lanyard cord opening 223 (not visible).

Figure 16:
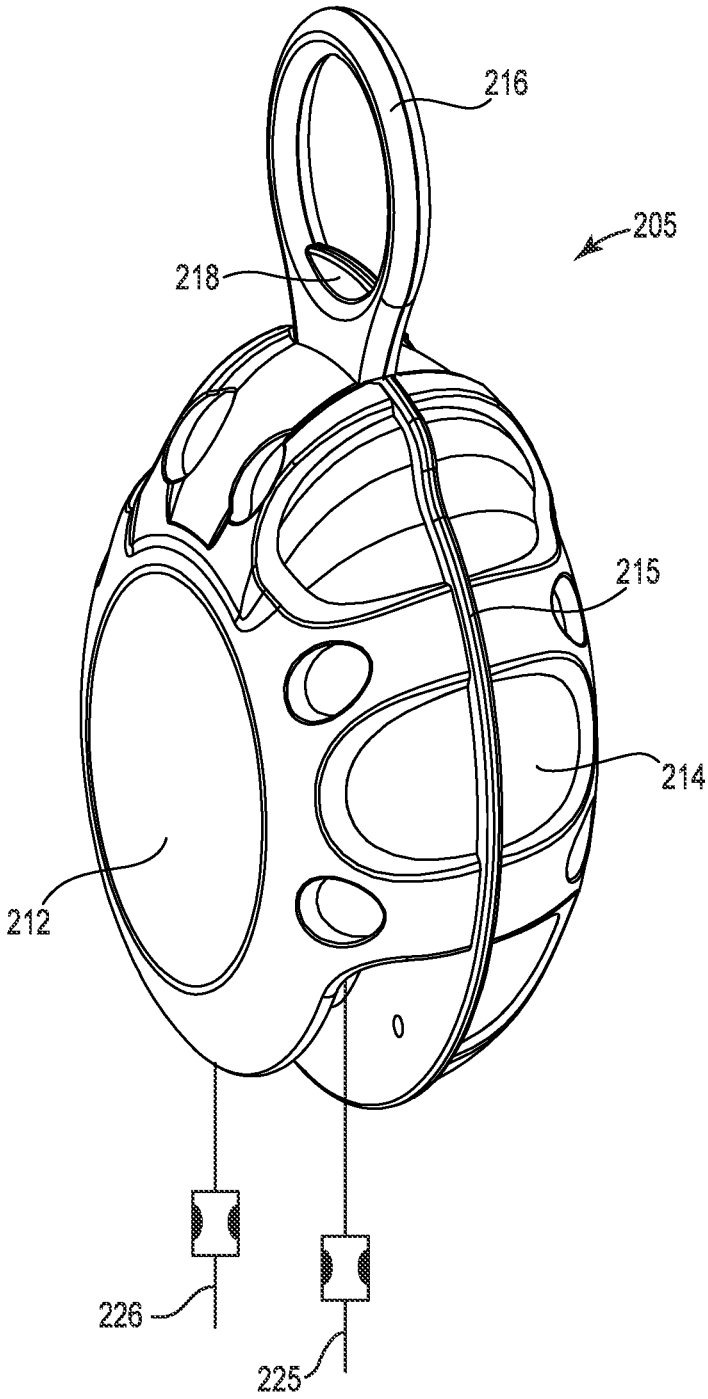
FIG. 16 is a perspective view of FIG. 15.

FIG. 16 depicts a perspective view of retractable lanyard 205. Lanyard housing 215 comprises front case 212 and rear case 214. Opening 220, allowing for the ingress and egress of lanyard cord 225, is formed in front case 212.

Figure 17:
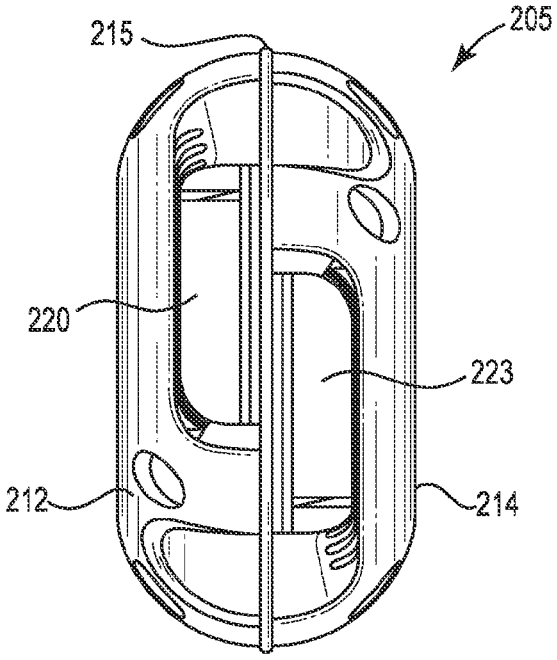
FIG. 17 is a bottom elevation view of FIG. 15.

FIG. 17 depicts an elevation bottom view of retractable lanyard 205. Rear lanyard opening 223 is formed in rear case 214.

Figure 18:
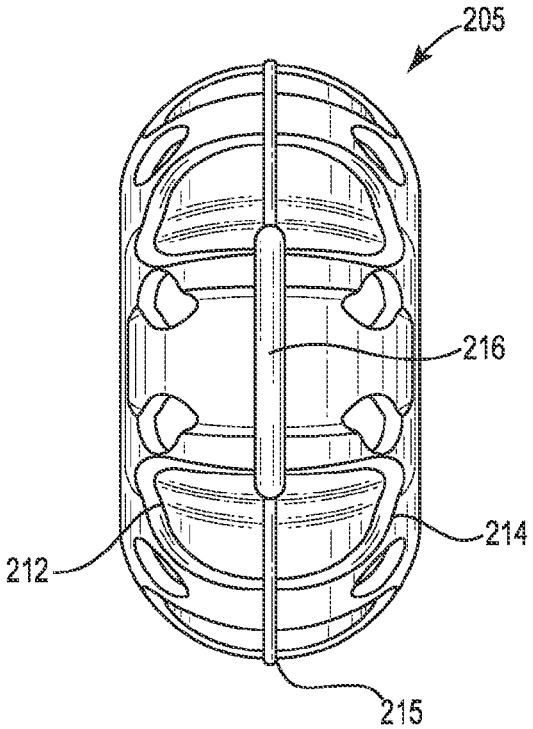
FIG. 18 is a plan view of FIG. 15.

FIG. 18 depicts a plan view of retractable lanyard 205.

Figure 19:
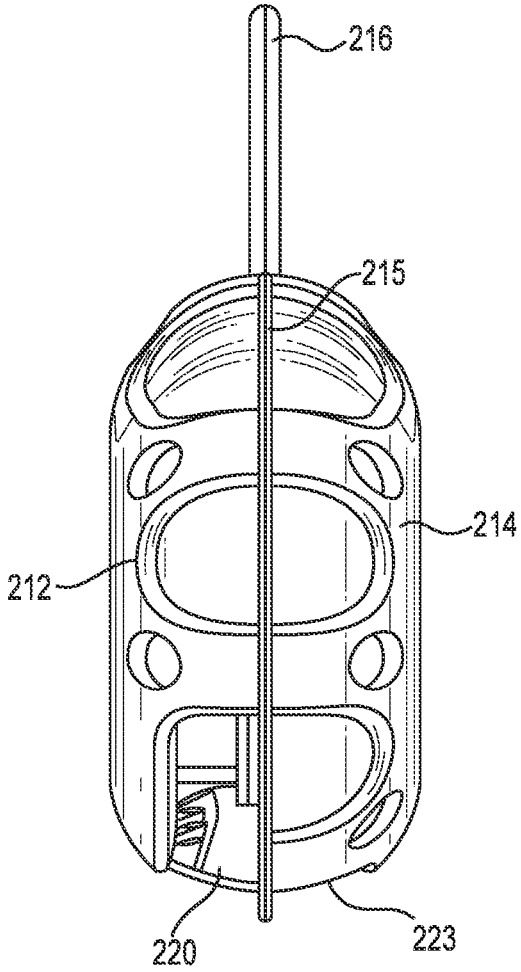
FIG. 19 is a side elevation view of FIG. 15.

FIG. 19 depicts an elevation side view of retractable lanyard 205.

Figure 20:
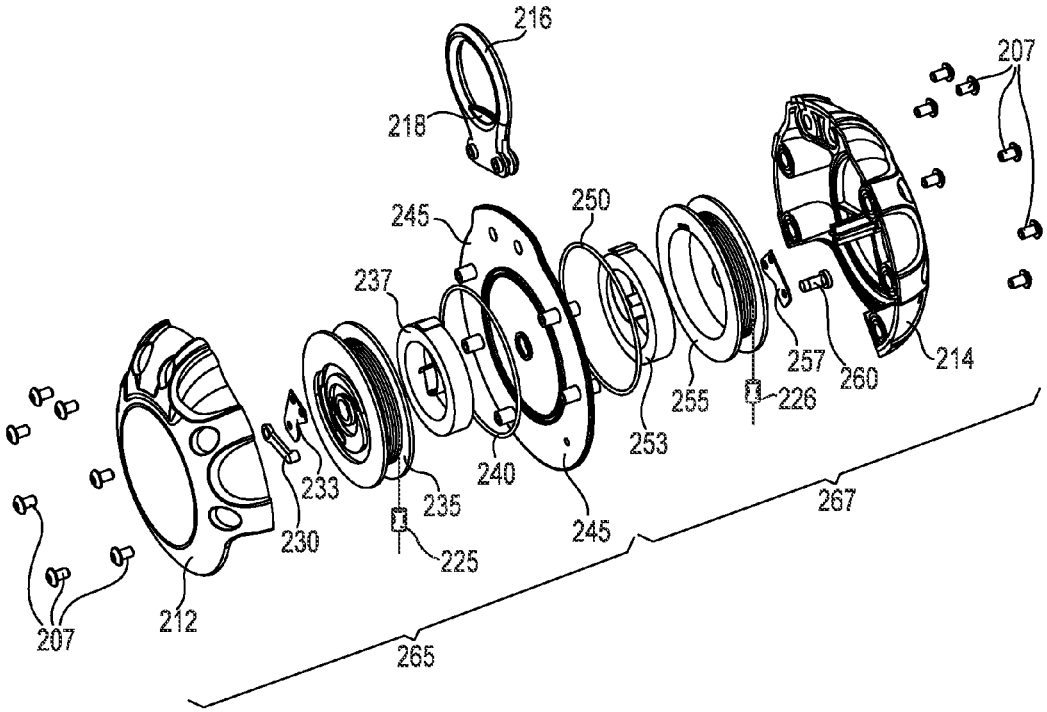
FIG. 20 is a perspective analytical view of the dual cord retractable lanyard invention.

FIG. 20 is an analytical perspective view of retractable lanyard 205. The internal components of retractable lanyard 205 comprise front reader arm 230, front reader arm bracket 233, front spool 235, front power spring 237, front O-ring 240, center plate 245, rear O-ring 250, rear power spring 253, rear spool 255, rear reader arm bracket 257 and rear reader arm 260. Attachment member 216 is preferably releasably, pivotally or fixably attached to a top portion of center plate 245. Preferably front spool 235 and rear spool 255 share a common axis.

Figure 6:
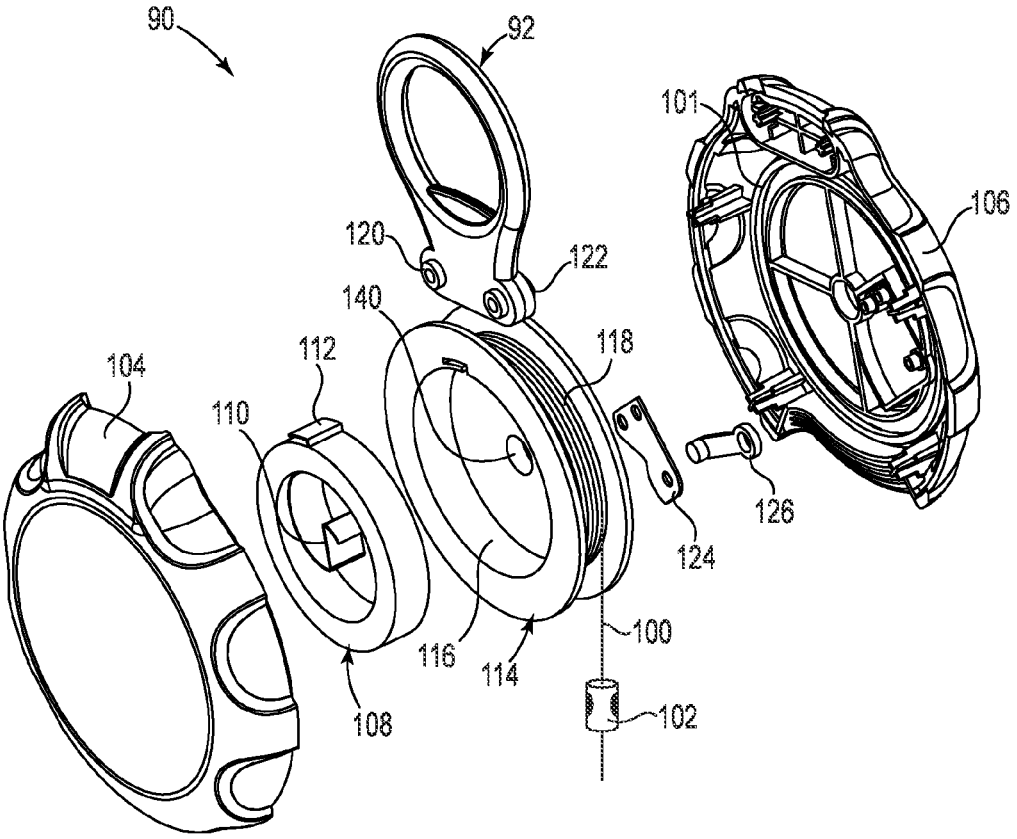
FIG. 6 is a perspective analytical view of the invention of FIG. 1.

Each of the front section 265 and rear section 267 of lanyard 205 are assembled onto center plate 245 in the same manner as the single spool embodiment of FIG. 6 was assembled between the front and rear cases. Each of the front section 265 and rear section 267 of retractable lanyard 205 operates as an independent lanyard in the same manner as lanyard 90. All the advantages described for lanyards 90 and 160 may also be incorporated into dual lanyard 205.

The thickness of the single spool retractable lanyard 90 and 160 is preferably less than 0.9 inches. The thickness of the dual spool retractable lanyard 205 is preferably less than 1.6 inches.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. For example, the dimensions and proportions indicated in the figures may be altered without departing from the scope of the inventions.

While the invention is amenable to various modifications and alternative forms, specifics thereof have been shown by way of example in the drawings and described in detail. It should be understood, however, that the intention is not to limit the invention to the particular example embodiments described. On the contrary, the invention is to cover all modifications, equivalents, and alternatives falling within the scope of the invention as defined by the appended claims.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A retractable lanyard comprising:

a housing having an exterior side and an interior side, the interior side defining a volume; the housing having disposed within the volume: a spool having a track side, a recessed side and a cord accepting portion on its perimeter; the track side of the spool having at least one dead-end track and one open-ended track; a power spring having an inner end and an outer end; the power spring inner end being fixably attached within the recessed side of the spool, and the outer end being fixably attached to the housing; a reader arm having a first end and a second end, the second end including a spring member and a sleeve member; a reader arm bracket having one portion configured to pivotally accept the first end of the reader arm and a second portion configured to fixably connect the reader arm bracket to the housing; and, wherein the reader arm second end is configured to ride within the tracks of the track side of the spool and the spring member is configured to urge the sleeve member of the reader arm second end into the tracks.

2. The retractable lanyard of claim 1 wherein the exterior side of the housing contains shock absorbing elastomeric portions.

3. The retractable lanyard of claim 1 wherein at least one O-ring is disposed within the volume of the housing.

4. The retractable lanyard of claim 1 wherein the sleeve member is rotatable.

5. The retractable lanyard of claim 1 wherein the reader arm second end extends into the tracks of the track side of the spool to a depth between 0.115 and 0.14 of an inch.

6. A retractable lanyard comprising:

a housing having an exterior and an interior, the exterior comprising shock absorbing elastomeric portions, and the interior defining a volume, the volume containing: a spool being rotatably mounted within the interior volume and having a track system on one side and a cord accepting portion on its perimeter; the track system having at least one dead-end track and one open-ended track; a power spring having an inner end and an outer end; the power spring inner end being fixably attached to the spool, and the outer end being fixably attached to the housing within the interior volume; a reader arm having a first end and a second end, the second end having a spring member and a sleeve member; the reader arm first end being pivotally attached to the housing within the interior volume; and, wherein the reader arm second end is configured to operably contact the track system and wherein the reader arm second end spring member urges the sleeve member into the track system.

7. The retractable lanyard of claim 6 wherein the housing further comprises an attachment member.

8. The retractable lanyard of claim 7 wherein the attachment member is ring shaped.

9. The retractable lanyard of claim 7 wherein the attachment member is pivotally attached to the housing.

10. The retractable lanyard of claim 7 wherein the attachment member, when fixably attached to a person or an object, separates from the housing if more than 15 pounds of weight is applied to the housing.

11. The retractable lanyard of claim 6 wherein the power spring is configured to retract under a weight of more than 1 pound.

12. The retractable lanyard of claim 6 wherein a cord is spooled on the perimeter of the spool, the cord having a useable length of between 35 and 45 inches.

13. The retractable lanyard of claim 6 further comprising a cord having a first end and a second end, the first end being attached to the perimeter of the spool, and a second end that extends from the interior volume of the housing via an opening in the housing; the second end of the cord having a clip disposed thereon, the clip having a first end configured to sealably mate with the opening in the housing when the cord is retracted by the force of the power spring.

* * * * *